US011072835B2

(12) United States Patent
Eguchi et al.

(10) Patent No.: US 11,072,835 B2
(45) Date of Patent: Jul. 27, 2021

(54) HIGH-STRENGTH SEAMLESS STAINLESS STEEL PIPE FOR OIL COUNTRY TUBULAR GOODS, AND METHOD FOR PRODUCING THE SAME

(71) Applicant: JFE Steel Corporation, Tokyo (JP)

(72) Inventors: Kenichiro Eguchi, Tokyo (JP); Yasuhide Ishiguro, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 128 days.

(21) Appl. No.: 16/318,978

(22) PCT Filed: Jun. 14, 2017

(86) PCT No.: PCT/JP2017/021955
§ 371 (c)(1),
(2) Date: Jan. 18, 2019

(87) PCT Pub. No.: WO2018/020886
PCT Pub. Date: Feb. 1, 2018

(65) Prior Publication Data

US 2019/0292618 A1 Sep. 26, 2019

(30) Foreign Application Priority Data

Jul. 27, 2016 (JP) ..... JP2016-146899

(51) Int. Cl.

| | |
|---|---|
| ***C21D 1/18*** | (2006.01) |
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |
| ***C21D 6/00*** | (2006.01) |

(52) U.S. Cl.

CPC ..... *C21D 8/105* (2013.01); *C21D 1/18* (2013.01); *C21D 6/004* (2013.01); *C21D 8/10* (2013.01); *C21D 9/08* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/60* (2013.01); *C21D 2211/001* (2013.01); *C21D 2211/004* (2013.01); *C21D 2211/005* (2013.01); *C21D 2211/008* (2013.01)

(58) Field of Classification Search

CPC . C21D 8/10; C21D 8/105; C21D 1/18; C21D 6/004; C21D 9/08; C21D 2211/001; C21D 2211/004; C21D 2211/005; C21D 2211/008; C22C 38/00; C22C 38/001; C22C 38/002; C22C 38/005; C22C 38/008; C22C 38/02; C22C 38/04; C22C 38/06; C22C 38/42; C22C 38/44; C22C 38/46; C22C 38/48; C22C 38/50; C22C 38/52; C22C 38/54; C22C 38/60

USPC ..... 148/592

See application file for complete search history.

(56) References Cited

U.S. PATENT DOCUMENTS

| | | | |
|---|---|---|---|
| 7,767,037 | B2 | 8/2010 | Kimura et al. |
| 8,608,872 | B2 | 12/2013 | Kondo et al. |
| 9,322,087 | B2 | 4/2016 | Takabe et al. |
| 9,758,850 | B2 | 9/2017 | Eguchi et al. |
| 10,151,011 | B2 | 12/2018 | Eguchi et al. |

(Continued)

FOREIGN PATENT DOCUMENTS

| | | | |
|---|---|---|---|
| EP | 1662015 | A1 | 5/2006 |
| EP | 2865777 | A1 | 4/2015 |

(Continued)

OTHER PUBLICATIONS

Chinese Office Action with Search Report for Chinese Application No. 201780046336.3, dated May 9, 2020, 9 pages.

Canadian Office Action for Canadian Application No. 3,026,564, dated Feb. 19, 2020, 3 pages.

Extended European Search Report for European Application No. 17 833 896.8, dated May 16, 2019, 13 pages.

International Search Report and Written Opinion for International Application No. PCT/JP2017/021955, dated Sep. 12, 2017—6 pages.

(Continued)

*Primary Examiner* — Brian D Walck

(74) *Attorney, Agent, or Firm* — RatnerPrestia

(57) ABSTRACT

Provided herein is a high-strength seamless stainless steel pipe. The high-strength seamless stainless steel pipe contains, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, and the balance being Fe and unavoidable impurities. C, Si, Mn, Cr, Ni, Mo, Cu, and N satisfy a specific formula. Cu, Mo, W, Cr, and Ni satisfy another specific formula. The high-strength seamless stainless steel pipe has more than 45% martensite phase, 10 to 45% ferrite phase, and 30% or less retained austenite phase. The total amount of precipitated Cr, precipitated Mo, and precipitated W is 0.75 mass % or less.

16 Claims, No Drawings

(56) References Cited

U.S. PATENT DOCUMENTS

| | | | | |
|---|---|---|---|---|
| 2006/0243354 | A1 | 11/2006 | Kimura | |
| 2007/0074793 | A1 | 4/2007 | Kimura et al. | |
| 2008/0047635 | A1 | 2/2008 | Kondo et al. | |
| 2012/0031530 | A1 | 2/2012 | Takabe et al. | |
| 2012/0118441 | A1 | 5/2012 | Kondo et al. | |
| 2012/0328897 | A1 | 12/2012 | Ohe et al. | |
| 2015/0101711 | A1 | 4/2015 | Miyata et al. | |
| 2015/0152531 | A1* | 6/2015 | Eguchi | C22C 38/008 148/592 |
| 2015/0315684 | A1* | 11/2015 | Eguchi | C22C 38/54 148/506 |
| 2016/0215359 | A1 | 7/2016 | Eguchi et al. | |
| 2017/0096722 | A1 | 4/2017 | Fujimura et al. | |
| 2017/0369963 | A1 | 12/2017 | Fujimura et al. | |
| 2018/0320243 | A1 | 11/2018 | Kamitani et al. | |
| 2019/0100821 | A1 | 4/2019 | Eguchi et al. | |
| 2019/0368001 | A1 | 12/2019 | Kamo et al. | |
| 2019/0376157 | A1 | 12/2019 | Kamo et al. | |
| 2020/0216936 | A1 | 7/2020 | Kamo et al. | |

FOREIGN PATENT DOCUMENTS

| | | | |
|---|---|---|---|
| EP | 2918697 | A1 | 9/2015 |
| EP | 3023507 | A1 | 5/2016 |
| EP | 3042968 | A1 | 7/2016 |
| JP | 101755 | A | 1/1998 |
| JP | 2005336595 | A | 12/2005 |
| JP | 2008081793 | A | 4/2008 |
| JP | 2011252222 | A | 12/2011 |
| JP | 2012149317 | A | 8/2012 |
| JP | 2015071822 | A | 4/2015 |
| JP | 2015110822 | A | 6/2015 |
| JP | 2017014543 | A | 1/2017 |
| JP | 6168245 | B1 | 7/2017 |
| WO | 2010050519 | A1 | 5/2010 |
| WO | 2010134498 | A1 | 11/2010 |
| WO | 2011021396 | A1 | 2/2011 |
| WO | 2011136175 | A1 | 11/2011 |
| WO | 2013179667 | A1 | 12/2013 |
| WO | 2014097628 | A1 | 6/2014 |
| WO | 2015178022 | A1 | 11/2015 |
| WO | 2016079920 | A1 | 5/2016 |
| WO | 2016113794 | A1 | 7/2016 |

OTHER PUBLICATIONS

Chinese Office Action for Chinese Application No. 201780046336.3, dated Nov. 3, 2020, with Concise Statement of Relevance of Office Action, 6 pages.
Non Final Office Action for U.S. Appl. No. 14/403,731, dated Jun. 21, 2017, 7 pages.
Final Office Action for U.S. Appl. No. 14/403,731, dated Oct. 20, 2017, 8 pages.
Non Final Office Action for U.S. Appl. No. 14/403,731, dated Aug. 13, 2018, 19 pages.
Final Office Action for U.S. Appl. No. 14/403,731, dated Feb. 13, 2019, 23 pages.
Non Final Office Action for U.S. Appl. No. 14/408,772, dated Dec. 20, 2016, 27 pages.
Non Final Office Action for U.S. Appl. No. 14/651,952, dated Apr. 5, 2017, 8 pages.
Final Office Action for U.S. Appl. No. 14/651,952, dated Jul. 24, 2017, 6 pages.
Non Final Office Action for U.S. Appl. No. 14/651,952, dated Dec. 7, 2017, 18 pages.
Final Office Action for U.S. Appl. No. 14/651,952. dated Apr. 13, 2018, 17 pages.
Non Final Office Action for U.S. Appl. No. 15/543,813, dated Mar. 6, 2019, 20 pages.
Final Office Action for U.S. Appl. No. 15/543,813, dated Jun. 10, 2019, 16 pages.
Non Final Office Action for U.S. Appl. No. 15/543,813, dated Oct. 23, 2019, 15 pages.
Non Final Office Action for U.S. Appl. No. 15/543,813, dated Nov. 20, 2019, 15 pages.
Non Final Office Action for U.S. Appl. No. 15/743,111, dated Jan. 3, 2020, 11 pages.
Final Office Action for U.S. Appl. No. 15/743,111, dated Apr. 28, 2020, 16 pages.
Non Final Office Action for U.S. Appl. No. 16/076,138, dated Oct. 28, 2020, 11 pages.
Chinese Office Action for Chinese Application No. 201780046336.3, dated Mar. 29, 2021 with Concise Statement of Relevance of Office Action, 6 pages.

* cited by examiner

HIGH-STRENGTH SEAMLESS STAINLESS STEEL PIPE FOR OIL COUNTRY TUBULAR GOODS, AND METHOD FOR PRODUCING THE SAME

CROSS REFERENCE TO RELATED APPLICATIONS

This is the U.S. National Phase application of PCT/JP2017/021955, filed. Jun. 14, 2017, which claims priority to Japanese Patent Application No. 2016-146899, filed Jul. 27, 2016, the disclosures of each of these applications being incorporated herein by reference in their entireties for all purposes.

FIELD OF THE INVENTION

The present invention relates to a high-strength seamless stainless steel pipe suitable for use in such as crude oil wells and natural gas wells (hereinafter, simply referred to as "oil wells"). Particularly, the invention relates to a high-strength seamless stainless steel pipe suitable for use in oil country tubular goods and having excellent carbon dioxide corrosion resistance in a very severe high-temperature corrosive environment containing carbon dioxide gas ($CO_2$) and chlorine ions ($Cl^-$), and excellent sulfide stress corrosion cracking resistance (SCC resistance) under high temperature, and excellent sulfide stress cracking resistance (SSC resistance) at ambient temperature in an environment containing hydrogen sulfide ($H_2S$). As used herein, "high-strength" means strength with a yield strength in the order of 125 ksi, that is, a yield strength of 862 MPa or more.

BACKGROUND OF THE INVENTION

Recently, rising crude oil prices, and concerned near future depletion of petroleum resources have prompted active development of deep oil fields that was unthinkable in the past, and oil fields and gas fields of a severe corrosive environment, or a sour environment as it is also called, where hydrogen sulfide and the like are present. Such oil fields and gas fields are typically very deep, and involve a severe, high-temperature corrosive environment of an atmosphere containing $CO_2$, $Cl^-$, and $H_2S$. Steel pipes for oil country tubular goods intended for use in such an environment require high strength, and high corrosion resistance performance (carbon dioxide corrosion resistance, sulfide stress corrosion cracking resistance, and sulfide stress cracking resistance).

13Cr martensitic stainless steel pipes are often used for oil country tubular goods (OCTG) which are used for mining of oil fields and gas fields of an environment containing carbon dioxide gas ($CO_2$), chlorine ions ($Cl^-$), and the like. Further, in recent years, modified 13Cr martensitic stainless steels with a reduced carbon content and increased contents of other components such as Ni and Mo based on the 13 Cr martensitic stainless steel are also in wide use.

For example, PTL 1 describes a modified martensitic stainless steel (pipe) that improves the corrosion resistance of a 13Cr martensitic stainless steel (pipe). The stainless steel (pipe) described in PTL 1 is a martensitic stainless steel having excellent corrosion resistance and excellent sulfide stress corrosion cracking resistance, and contains, in weight %, C: 0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, N: 0.005% to 0.1%, and the balance being Fe and unavoidable impurities, in which the Ni equivalent (Ni eq) satisfies 40C+34N+Ni+0.3Cu−1.1Cr−1.8Mo−10. The martensitic stainless steel has a tempered martensite phase, a martensite phase, and a retained austenite phase, wherein the total fraction of the tempered martensite phase and the martensite phase is 60% or more and 90% or less, and the remainder is the retained austenite phase. This improves the corrosion resistance and the sulfide stress corrosion cracking resistance in a wet carbon dioxide gas environment, and in a wet hydrogen sulfide environment.

There has been recent development of oil wells in a corrosive environment of even higher temperatures (as high as 200° C.). However, with the technique described in PTL 1, the desired corrosion resistance cannot be sufficiently ensured in a stable fashion in such a high-temperature corrosive environment.

This has created a demand for a steel pipe for oil country tubular goods having excellent corrosion resistance and excellent sulfide stress corrosion cracking resistance even when used in such a high-temperature corrosive environment and a wide variety of martensitic stainless steel pipes are proposed.

For example, PTL 2 describes a high-strength stainless steel pipe with excellent corrosion resistance having a composition containing, in massa, C: 0.005 to 0.05%, Si: 0.05 to 0.5%, Mn: 0.2 to 1.8%, P: 0.03% or less, S: 0.005% or less, Cr: 15.5 to 18%, Ni: 1.5 to 5%, Mo: 1 to 3.5%, V: 0.02 to 0.2%, N: 0.01 to 0.15%, and O: 0.006% or less, wherein the Cr, Ni, Mo, Cu, and C satisfy a specific relational expression, and the Cr, Mo, Si, C, Mn, Ni, Cu, and N satisfy a specific relational expression. The stainless steel pipe has a structure with a martensite phase as a base phase, and contains 10 to 60% ferrite phase, and 30% or less austenite phase by volume in the structure. In this way, the stainless steel pipe can have sufficient corrosion resistance even in a severe, $CO_2$- and $Cl^-$-containing corrosive environment of a temperature as high as 230° C., and a high-strength and high-toughness stainless steel pipe for oil country tubular goods can be stably produced.

PTL 3 describes a high-strength stainless steel pipe for oil country tubular goods having high toughness and excellent corrosion resistance. The technique described in PTL 3 produces a steel pipe of a composition containing, in mass %, C: 0.04% or less, Si: 0.50% or less, Mn: 0.20 to 1.80%, P: 0.03% or less, S: 0.005% or less, Cr: 15.5 to 17.5%, Ni: 2.5 to 5.5%, V: 0.20% or less, Mo: 1.5 to 3.5%, W: 0.50 to 3.0%, Al: 0.05% or less, N: 0.15% or less, and O: 0.006% or less, wherein the Cr, Mo, W, and C satisfy a specific relational expression, the Cr, Mo, W, Si, C, Mn, Cu, Ni, and N satisfy a specific relational expression, and the Mo and W satisfy a specific relational expression. Further, the high-strength stainless steel pipe has a structure with a martensite phase as a base phase, and contains 10 to 50% ferrite phase by volume in the structure. The technique enables producing a high-strength stainless steel pipe for oil country tubular goods having sufficient corrosion resistance even in a severe, $CO_2$-, $Cl^-$-, and $H_2S$-containing high-temperature corrosive environment.

PTL 4 describes a high-strength stainless steel pipe having excellent sulfide stress cracking resistance, and excellent high-temperature carbon dioxide gas corrosion resistance. The technique described in PTL 4 produces a steel pipe of a composition containing, in mass %, C: 0.05% or less, Si: 1.0% or less, P: 0.05% or less, S: less than 0.002%, Cr: more than 16% and 18% or less, Mo: more than 2% and 3% or less, Cu: 1 to 3.5%, Ni: 3% or more and less than 5%, Al: 0.001 to 0.1%, and O: 0.01% or less, wherein the Mn and N satisfy specific relationship in a range of 1% or less of Mn, and 0.05% or less of N. The high-strength stainless steel pipe has a structure that is primarily a martensite phase, and that contains 10 to 40% ferrite phase, and 10% or less retained γ phase by volume. The technique enables producing a high-strength stainless steel pipe having excellent corrosion resistance, which has the sufficient corrosion resistance even in a carbon dioxide gas environment of a temperature as high as 200° C., and has sufficient sulfide stress cracking resistance even at lowered ambient gas temperatures.

PTL 5 describes a stainless steel for oil country tubular goods having a proof strength of 758 MPa or more. The stainless steel has a composition containing, in mass %, C: 0.05% or less, Si: 0.5% or less, Mn: 0.01 to 0.5%, P: 0.04% or less, S: 0.01% or less, Cr: more than 16.0 to 18.0%, Ni: more than 4.0 to 5.6%, Mo: 1.6 to 4.0%, Cu: 1.5 to 3.0%, Al: 0.001 to 0.10%, and N: 0.050% or less, wherein the Cr, Cu, Ni, and Mo satisfy a specific relationship, and (C+N), Mn, Ni, Cu, and (Cr+Mo) satisfy a specific relationship. The stainless steel has a structure with a martensite phase and 10 to 40% by volume of ferrite phase, wherein the proportion of the ferrite phase that crosses a plurality of imaginary segments measuring 50 μm in length and arranged in a line over a region of 200 μm from the surface in the thickness direction in a pitch of 10 μm is larger than 85%. In this way, the stainless steel for oil country tubular goods has excellent corrosion resistance in a high-temperature environment, and excellent SSC resistance at ambient temperature.

PTL 6 describes containing, in mass %, C: 0.05% or less, Si: 0.5% or less, Mn: 0.15 to 1.0%, P: 0.030% or less, S: 0.005% or less, Cr: 15.5 to 17.5%, Ni: 3.0 to 6.0%, Mo: 1.5 to 5.0%, Cu: 4.0% or less, W: 0.1 to 2.5%, and N: 0.15% or less, so as to satisfy $-5.9\times(7.82+27C-0.91Si+0.21Mn-0.9Cr+Ni-1.1Mo+0.2Cu+11N)\geq 13.0$, Cu+Mo+0.5W 5.8, and Cu+Mo+W+Cr+2Ni S 34.5. In this way, the high-strength seamless stainless steel pipe having excellent corrosion resistance, which has excellent carbon dioxide corrosion resistance in a $CO_2$- and $Cl^-$-containing high-temperature environment as high as 200° C., and further has excellent sulfide stress cracking resistance and excellent sulfide stress corrosion cracking resistance in a $H_2S$-containing corrosive environment, can be produced.

PATENT LITERATURE

PTL 1: JP-A-10-1755
PTL 2: JP-A-2005-336595
PTL 3: JP-A-2008-81793
PTL 4: WO2010/050519
PTL 5: WO2010/134498
PTL 6: JP-A-2015-110822

SUMMARY OF THE INVENTION

As the oil fields and gas fields of a severe corrosive environment are developed, steel pipes for oil country tubular goods are required to have high strength, and excellent corrosion resistance, including carbon dioxide corrosion resistance, and sulfide stress corrosion cracking resistance (SCC resistance) and sulfide stress cracking resistance (SSC resistance), even in a severe, $CO_2$, $Cl^-$-, and $H_2S$-containing corrosive environment of high temperatures of 200° C. or more.

However, it is a problem that in the techniques described in PTL 2 to PTL 5, they fail to provide sufficient SSC resistance in an environment with a high $H_2S$ partial pressure.

It is also a problem that in PTL 2, 3, and 6, they fail to provide high strength with a yield strength of 862 MPa or more, and high toughness with an absorption energy at −40° C. of 100 J or more.

It was found that high toughness with an absorption energy at −40° C. of 100 J or more cannot be satisfied with the level of absorption energy, 149 to 197 J at −10° C., described in the Examples of the specification in PTL 6.

The techniques described in PTL 1 to 6 add large amounts of Cr, Mo, W, and the like to achieve high corrosion resistance. However, these elements precipitate as intermetallic compounds during tempering, and high low-temperature toughness cannot be obtained. It is a problem that with low low-temperature toughness, the stainless steel pipes cannot be used in cold climates.

Aspects of the present invention are intended to provide solutions to the foregoing problems of the related art, and it is an object according to aspects of the present invention to provide a high-strength seamless stainless steel pipe for oil country tubular goods exhibiting high strength and excellent low-temperature toughness, and having excellent corrosion resistance including excellent carbon dioxide corrosion resistance, and excellent sulfide stress corrosion cracking resistance and excellent sulfide stress cracking resistance, even in a severe corrosive environment such as described above. Aspects of the invention are also intended to provide a method for producing such a high-strength seamless stainless steel pipe.

As used herein, "high-strength" means a yield strength of 125 ksi (862 MPa) or more.

As used herein, "excellent low-temperature toughness" means having an absorption energy of 100 J or more at −40° C. as measured in a Charpy impact test performed with a V-notch test piece (10 mm thick) according to JIS Z 2242.

As used herein, "excellent carbon dioxide corrosion resistance" means that a test piece dipped in a test solution: 20 mass % NaCl aqueous solution (liquid temperature: 200° C.; 30 atm $CO_2$ gas atmosphere) charged into an autoclave has a corrosion rate of 0.125 mm/y or less after 336 hours in the solution.

As used herein, "excellent sulfide stress corrosion cracking resistance" means that a test piece dipped in a test solution: an aqueous solution having an adjusted pH of 3.3 with addition of an aqueous solution of acetic acid and sodium acetate to a 20 mass % NaCl aqueous solution (liquid temperature: 100° C.; a 30 atm $CO_2$ gas and 0.1 atm $H_2S$ atmosphere) and hold in an autoclave does not crack even after 720 hours under an applied stress equal to 100% of the yield stress.

As used herein, "excellent sulfide stress cracking resistance" means that a test piece dipped in a test solution: an aqueous solution having an adjusted pH of 3.5 with addition of an aqueous solution of acetic acid and sodium acetate to a 20 mass % NaCl aqueous solution (liquid temperature: 25° C.; a 0.9 atm $CO_2$ gas and 0.1 atm $H_2S$ atmosphere) and hold in an autoclave does not crack, even after 720 hours under an applied stress equal to 90% of the yield stress.

In order to achieve the foregoing objects, the present inventors conducted intensive studies of stainless steel pipes of a Cr-containing composition from the perspective of corrosion resistance, with regard to various factors that might affect low-temperature toughness at −40° C. The studies found that a high-strength seamless stainless steel pipe having both excellent carbon dioxide corrosion resistance and excellent high-temperature sulfide stress corrosion cracking resistance in a high-temperature corrosive environment as high as 200° C. and containing $CO_2$-, $Cl^-$-, and $H_2S$, and in an environment of a $CO_2$, $Cl^-$, and $H_2S$-containing corrosive atmosphere under an applied stress close to the yield strength can be obtained, when the stainless steel pipe has a structure having a complex structure that is more than 45% primary martensite phase, 10 to 45% secondary ferrite phase, and 30% or less retained austenite phase by volume. It was also found that a high-strength seamless stainless steel pipe having excellent sulfide stress cracking resistance in a high-concentration $H_2S$ environment can be obtained, when the stainless steel pipe has the structure further containing Cr, Mo, and W higher than certain quantities, respectively.

After further studies, the present inventors found that adjusting the C, Si, Mn, Cr, Ni, Mo, Cu, and N contents to satisfy the following formula (1) is important to provide the desired composite structure in a composition containing 14.5 mass % or more of Cr.

$$-5.9\times(7.82+27C-0.91Si+0.21Mn-0.9Cr+Ni-1.1Mo+0.2Cu+11N)\geq 13.0, \quad \text{Formula (1)}$$

where C, Si, Mn, Cr, Ni, Mo, Cu, and N represent the contents of corresponding elements (mass %), respectively.

The left-hand side of the formula (1) is experimentally determined by the present inventors as an index that indicates the likelihood of occurrence of the ferrite phase. The present inventors found that adjusting the alloy elements and the amounts thereof so as to satisfy the formula (1) is important to achieve the desired complex structure.

It was also found that excessive generation of retained austenite can be suppressed, and the desired high-strength and sulfide stress cracking resistance can be provided by adjusting the Cu, Mo, W, Cr, and Ni contents to satisfy the following formula (2).

$$Cu+Mo+W+Cr+2Ni\leq 34.5, \quad \text{Formula (2)}$$

where Cu, Mo, W, Cr, and Ni represent the contents of corresponding elements (massa), respectively.

As noted above, it was a problem that high low-temperature toughness may not be obtained when elements such as Cr, Mo, and W are contained in large quantities because these elements precipitate as intermetallic compounds during tempering. Addressing this problem, the present inventors found that excellent low-temperature toughness with a Charpy absorption energy at −40° C. of 100 J can be achieved when the total quantity of the precipitated Cr, precipitated Mo, and precipitated W is 0.75 mass % or less after tempering.

Here, a composition with a high Cr content of 14.5 mass % or more, and a complex structure of primarily a martensite phase with a secondary ferrite phase and a retained austenite phase, and further the composition containing Cr, Mo, and W each in an amount not less than a specific amount can contribute to not only excellent carbon dioxide corrosion resistance but excellent sulfide stress corrosion cracking resistance and excellent sulfide stress cracking resistance. In this regards, the present inventors think as follows.

The ferrite phase provides excellent pitting corrosion resistance, and precipitates in a laminar fashion in the rolling direction, that is, the axial direction of the pipe. Therefore the laminar structure is perpendicular to the direction of applied stress in a sulfide stress crack test, and a sulfide stress corrosion crack test. Thus, cracks propagate in such a manner that divides the laminar structure. Accordingly, crack propagation is suppressed, and the SSC resistance, and the SCC resistance improve.

Excellent carbon dioxide corrosion resistance is achieved when the composition contains a reduced carbon content of 0.05 mass % or less, and 14.5 mass % or more of Cr, 3.0 mass % or more of Ni, and 2.7 mass % or more of Mo.

Aspects of the present invention are based on these findings, and were completed after further studies. Specifically, aspects of the present invention are as follows.

[1] A high-strength seamless stainless steel pipe for oil country tubular goods having a yield strength of 862 MPa or more, the high-strength seamless stainless steel pipe having a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, and the balance being Fe and unavoidable impurities, and in which the C, Si, Mn, Cr, Ni, Mo, Cu, and N satisfy the formula (1) below, and the Cu, Mo, W, Cr, and Ni satisfy the formula (2) below, the high-strength seamless stainless steel pipe having a structure comprising more than 45% martensite phase by volume as a primary phase, and 10 to 45% ferrite phase and 30% or less retained austenite phase by volume as a secondary phase, wherein the total amount of precipitated Cr, precipitated Mo, and precipitated W is 0.75 mass % or less.

$$-5.9\times(7.82+27C-0.91Si+0.21Mn-0.9Cr+Ni-1.1Mo+0.2Cu+11N)\geq 13.0, \quad \text{Formula (1)}$$

where C, Si, Mn, Cr, Ni, Mo, Cu, and N represent the contents of corresponding elements (mass %), respectively.

$$Cu+Mo+W+Cr+2Ni\leq 34.5, \quad \text{Formula (2)}$$

where Cu, Mo, W, Cr, and Ni represent the contents of corresponding elements (mass %), respectively.

[2] The high-strength seamless stainless steel pipe for oil country tubular goods according to the item [1], wherein the composition further comprises, in mass %, at least one selected from Nb: 0.02 to 0.50%, Ti: 0.02 to 0.16%, Zr: 0.02 to 0.50%, and B: 0.0005 to 0.0030%.

[3] The high-strength seamless stainless steel pipe for oil country tubular goods according to the item [1] or [2], wherein the composition further comprises, in mass %, at least one selected from REM: 0.001 to 0.05%, Ca: 0.001 to 0.005%, Sn: 0.05 to 0.20%, and Mg: 0.0002 to 0.01%.

[4] The high-strength seamless stainless steel pipe for oil country tubular goods according to any one of the items [1] to [3], wherein the composition further comprises, in mass %, at least one selected from Ta: 0.01 to 0.1%, Co: 0.01 to 1.0%, and Sb:0.01 to 1.0%.

[5] A method for producing the high-strength seamless stainless steel pipe for oil country tubular goods of any one of the items [1] to [4], the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T)\leq 0.034 \quad (3),$$

where T is the tempering temperature (° C.), t is the duration of tempering (min), and Cr, Mo, W, Ni, and Cu represent the contents of corresponding elements (mass %), respectively.

Aspects of the present invention can provide a high-strength seamless stainless steel pipe having high strength and excellent low-temperature toughness, and excellent corrosion resistance including excellent carbon dioxide corrosion resistance, and excellent sulfide stress corrosion cracking resistance and excellent sulfide stress cracking resistance, even in a severe corrosive environment such as described above.

DETAILED DESCRIPTION OF EMBODIMENTS OF THE INVENTION

A high-strength seamless stainless steel pipe for oil country tubular goods according to aspects of the present invention has a composition containing, in massa, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 0.1 to 2.5%, V: 0.02 to 0.20%, Al: 0.10% or less, N: 0.15% or less, and the balance being Fe and unavoidable impurities, wherein the C, Si, Mn, Cr, Ni, Mo, Cu, and N contents are adjusted to satisfy the following formula (1), and the Cu, Mo, W, Cr, and Ni contents are adjusted to satisfy the following formula (2).

$$-5.9\times(7.82+27C-0.91Si+0.21Mn-0.9Cr+Ni-1.1Mo+0.2Cu+11N)\geq 13.0, \quad \text{Formula (1)}$$

where C, Si, Mn, Cr, Ni, Mo, Cu, and N represent the contents of corresponding elements (mass %), respectively $$Cu+Mo+W+Cr+2Ni\leq 34.5, \quad \text{Formula (2)}$$

where Cu, Mo, W, Cr, and Ni represent the contents of corresponding elements (mass %), respectively.

The total amount of precipitated Cr, precipitated Mo, and precipitated W is 0.75 mass % or less after tempering.

The reasons for specifying the composition of the steel pipe according to aspects of the present invention are as follows. In the following, "%" means percent by mass, unless otherwise specifically stated.

C: 0.05% or Less

Carbon is an important element to increase the strength of the martensitic stainless steel. In accordance with aspects of the present invention, carbon is desirably contained in an amount of 0.005% or more to provide the desired strength. A carbon content of more than 0.05% deteriorates the carbon dioxide corrosion resistance, and the sulfide stress corrosion cracking resistance. For this reason, the C content is 0.05% or less. The C content is preferably 0.005 to 0.04%, more preferably 0.005 to 0.02%.

Si: 0.5% or Less

Silicon is an element that acts as a deoxidizing agent. This effect is obtained with a Si content of 0.1% or more. Si content in excess of 0.5% deteriorates hot workability. For this reason, the Si content is 0.5% or less. The Si content is preferably 0.1 to 0.5%, more preferably 0.2 to 0.3%.

Mn: 0.15 to 1.0%

Manganese is an element that increases steel strength. In accordance with aspects of the present invention, manganese needs to be contained in an amount of 0.15% or more to provide the desired strength. A Mn content in excess of 1.0% deteriorates toughness. For this reason, the Mn content is 0.15 to 1.0%. The Mn content is preferably 0.20 to 0.50%, more preferably 0.20 to 0.40%.

P: 0.030% or less

In accordance with aspects of the present invention, phosphorus should desirably be contained in as small an amount as possible because this element deteriorates corrosion resistance such as carbon dioxide corrosion resistance, pitting corrosion resistance, and sulfide stress cracking resistance. However, a P content of 0.030% or less is acceptable. For this reason, the P content is 0.030% or less, preferably 0.020% or less, more preferably 0.015% or less. The P content is preferably 0.005% or more because it is highly costly to make the P content less than 0.005%.

S: 0.005% or Less

Desirably, sulfur should be contained in as small an amount as possible because this element is highly detrimental to hot workability, and interferes with a stable operation of the pipe manufacturing process. However, normal pipe production is possible when the S content is 0.005% or less. For this reason, the S content is 0.005% or less, preferably 0.002% or less, more preferably 0.0015% or less. The S content is preferably 0.0005% or more because it is highly costly to make the S content less than 0.0005%.

Cr: 14.5 to 17.5%

Chromium is an element that forms a protective coating, and contributes to improving the corrosion resistance. In accordance with aspects of the present invention, chromium needs to be contained in an amount of 14.5% or more to provide the desired corrosion resistance. With a Cr content of more than 17.5%, the ferrite fraction becomes overly high, and it is not possible to provide the desired high strength. It also causes precipitation of intermetallic compounds during tempering, and deteriorates low-temperature toughness. For this reason, the Cr content is 14.5 to 17.5%, preferably 15.0 to 17.0%, more preferably 15.0 to 16.5%.

Ni: 3.0 to 6.0%

Nickel is an element that strengthens the protective coating, and improves the corrosion resistance. Nickel also increases steel strength through solid solution strengthening. Such effects are obtained with a Ni content of 3.0% or more. With a Ni content of more than 6.0%, the stability of the martensite phase decreases, and the strength decreases. For this reason, the Ni content is 3.0 to 6.0%, preferably 3.5 to 5.5%, more preferably 4.0 to 5.5%.

Mo: 2.7 to 5.0%

Molybdenum is an element that improves resistance to pitting corrosion due to $Cl^-$ and low pH, and improves the sulfide stress cracking resistance and the sulfide stress corrosion cracking resistance. In accordance with aspects of the present invention, molybdenum needs to be contained in an amount of 2.7% or more. With a Mo content of less than 2.7%, sufficient corrosion resistance cannot be obtained in a severe corrosive environment. Molybdenum is an expensive element, and a large Mo content in excess of 5.0% causes precipitation of intermetallic compounds, and deteriorates toughness and corrosion resistance. For this reason, the Mo content is 2.7 to 5.0%, preferably 3.0 to 5.0%, more preferably 3.3 to 4.7%.

Cu: 0.3 to 4.0%

Copper is an important element that strengthens the protective coating, and suppresses entry of hydrogen to the steel. Copper also improves the sulfide stress cracking resistance, and the sulfide stress corrosion cracking resistance. Copper needs to be contained in an amount of 0.3% or more to obtain such effects. A Cu content of more than 4.0% leads to precipitation of CuS at grain boundaries, and deteriorates hot workability and corrosion resistance. For this reason, the Cu content is 0.3 to 4.0%, preferably 1.5 to 3.5%, more preferably 2.0 to 3.0%.

W: 0.1 to 2.5%

Tungsten is a very important element that contributes to improving steel strength and improves the sulfide stress corrosion cracking resistance and the sulfide stress cracking resistance. When contained with molybdenum, tungsten improves the sulfide stress cracking resistance. Tungsten needs to be contained in an amount of 0.1% or more to obtain such effects. A large W content of more than 2.5% causes precipitation of intermetallic compounds, and deteriorates toughness. For this reason, the W content is 0.1 to 2.5%, preferably 0.8 to 1.2%, more preferably 1.0 to 1.2%.

V: 0.02 to 0.20%

Vanadium is an element that improves steel strength through precipitation strengthening. Such an effect can be obtained when vanadium is contained in an amount of 0.02% or more. A V content of more than 0.20% deteriorates toughness. For this reason, the V content is 0.02 to 0.20%, preferably 0.04 to 0.08%, more preferably 0.05 to 0.07%.

Al: 0.10% or Less

Aluminum is an element that acts as a deoxidizing agent. Such an effect can be obtained when aluminum is contained in an amount of 0.001% or more. With an Al content of more than 0.10%, the oxide amount becomes excessive, and the toughness deteriorates. For this reason, the Al content is 0.10% or less, preferably 0.001 to 0.10%, more preferably 0.01 to 0.06%, even more preferably 0.02 to 0.05%.

N: 0.15% or Less

Nitrogen is an element that highly improves the pitting corrosion resistance. Such an effect becomes more pronounced when nitrogen is contained in an amount of 0.01% or more. A nitrogen content of more than 0.15% results in formation of various nitrides, and the toughness deteriorates. For this reason, the N content is 0.15% or less, preferably 0.07% or less, more preferably 0.05% or less. Preferably, the N content is 0.01% or more.

In accordance with aspects of the present invention, while the specific components are contained in specific amounts, C, Si, Mn, Cr, Ni, Mo, Cu, and N satisfy the following formula (1), and Cu, Mo, W, Cr, and Ni satisfy the following formula (2).

$$-5.9\times(7.82+27C-0.91Si+0.21Mn-0.9Cr+Ni-1.1Mo+0.2Cu+11N)\geq 13.0 \quad \text{Formula (1)}$$

In the formula (1), C, Si, Mn, Cr, Ni, Mo, Cu, and N represent the contents of corresponding elements (mass %), respectively.

The left-hand side of the formula (1) represents an index that indicates the likelihood of occurrence of the ferrite phase. By containing the alloy elements of formula (1) in adjusted amounts so as to satisfy the formula (1), a complex structure of the martensite phase and the ferrite phase or that further including a retained austenite phase can be stably achieved. The amount of each alloy element is therefore adjusted to satisfy the formula (1) in accordance with aspects of the present invention. It should be noted that when the alloy elements shown in formula (1) are not contained, the contents of these elements on the left-hand side of the formula (1) are regarded as 0 percent.

$$Cu+Mo+W+Cr+2Ni\leq 34.5 \quad \text{Formula (2)}$$

In the formula (2), Cu, Mo, W, Cr, and Ni represent the contents of corresponding elements (mass %), respectively.

The left-hand side of the formula (2) is newly derived by the present inventors as an index that indicates the likelihood of occurrence of the retained austenite. When the value on the left-hand side of formula (2) exceeds 34.5, an amount of the retained austenite becomes excessive, and the desired high-strength cannot be provided. The sulfide stress cracking resistance and the sulfide stress corrosion cracking resistance also deteriorate. For this reason, Cu, Mo, W, Cr, and Ni are adjusted to satisfy the formula (2) in accordance with aspects of the present invention. The value on the left-hand side of the formula (2) is preferably 32.5 or less, more preferably 31 or less.

The total amount of precipitated Cr, precipitated Mo, and precipitated W is adjusted to 0.75 mass % or less. The desired low-temperature toughness cannot be obtained when this value is more than 0.75%. The total amount of precipitated Cr, precipitated Mo, and precipitated W is preferably 0.50% or less.

As used herein, "precipitated Cr" refers to chromium carbide, chromium nitride, chromium carbonitride, or a complex of these, "precipitated Mo" refers to molybdenum carbide, molybdenum nitride, molybdenum carbonitride, or a complex of these, and "precipitated W" refers to tungsten carbide, tungsten nitride, tungsten carbonitride, or a complex of these.

The amounts of precipitated Cr, precipitated Mo, and precipitated W can be obtained by measuring the amounts of Cr, Mo, and W in the residue obtained by using an electro-extraction residue method.

The foregoing components are the basic components, and the balance other than the foregoing components is Fe and unavoidable impurities. Acceptable as unavoidable impurities is O (oxygen): 0.01% or less.

In addition to the basic components, the following optional elements may be contained in accordance with aspects of the present invention, as needed. At least one selected from Nb: 0.02 to 0.50%, Ti: 0.02 to 0.16%, Zr: 0.02 to 0.50%, and B: 0.0005 to 0.0030%, and/or at least one selected from REM: 0.001 to 0.05%, Ca: 0.001 to 0.005%, Sn: 0.05 to 0.20%, and Mg: 0.0002 to 0.01%, and/or at least one selected from Ta: 0.01 to 0.1%, Co: 0.01 to 1.0%, and Sb: 0.01 to 1.0%.

At Least One Selected from Nb: 0.02 to 0.50%, Ti: 0.02 to 0.16%, Zr: 0.02 to 0.50%, and B: 0.0005 to 0.0030%

Nb, Ti, Zr, and B are elements that contribute to increasing strength, and, may be contained by being selected, as needed.

In addition to increasing strength as mentioned above, niobium contributes to improving toughness. Niobium is contained in an amount of preferably 0.02% or more to provide such effects. A Nb content of more than 0.50% deteriorates toughness. For this reason, niobium, when contained, is contained in an amount of 0.02 to 0.50%.

In addition to increasing strength as mentioned above, titanium contributes to improving sulfide stress cracking resistance. Titanium is contained in an amount of preferably 0.02% or more to obtain such effects. When the titanium content is more than 0.16%, coarse precipitates occur, and the toughness and the sulfide stress corrosion cracking resistance deteriorate. For this reason, titanium, when contained, is contained in an amount of 0.02 to 0.16%.

In addition to increasing strength as mentioned above, zirconium contributes to improving sulfide stress corrosion cracking resistance. Zirconium is contained in an amount of preferably 0.02% or more to obtain such effects. A Zr content of more than 0.50% deteriorates toughness. For this reason, zirconium, when contained, is contained in an amount of 0.02 to 0.50%.

In addition to increasing strength as mentioned above, boron contributes to improving hot workability. Boron is contained in an amount of preferably 0.0005% or more to obtain such effects. A B content of more than 0.0030% deteriorates toughness, and deteriorate hot workability. For this reason, boron, when contained, is contained in an amount of 0.0005 to 0.0030%.

At Least One Selected from REM: 0.001 to 0.05%, Ca: 0.001 to 0.005%, Sn: 0.05 to 0.20%, and Mg: 0.0002 to 0.01%

REM, Ca, Sn, and Mg are elements that contribute to improving sulfide stress corrosion cracking resistance, and may be contained by being selected, as needed. The preferred contents for providing such an effect are 0.001% or more for REM, 0.001% or more for Ca, 0.05% or more for Sn, and 0.0002% or more for Mg. It is not economically advantageous to contain REM in excess of 0.05%, Ca in excess of 0.005%, Sn in excess of 0.20%, and Mg in excess of 0.01% because the effect becomes saturated and is not expected the effect corresponding to the content. For this reason, REM, Ca, Sn, and Mg, when contained, are contained in amounts of 0.001 to 0.005%, 0.001 to 0.005%, 0.05 to 0.20%, and 0.0002 to 0.01%, respectively.

At Least One Selected from Ta: 0.01 to 0.1%, Co: 0.01 to 1.0%, and Sb: 0.01 to 1.0%

Ta, Co, and Sb are elements that contribute to improving carbon dioxide corrosion resistance ($CO_2$ corrosion resistance), sulfide stress cracking resistance, and sulfide stress corrosion cracking resistance, and may be contained by being selected, as needed. Cobalt also contributes to raising the Ms point, and increasing strength. The preferred contents for providing such effects are 0.01% or more for Ta, 0.01% or more for Co, and 0.01% or more for Sb. The effect becomes saturated and is not expected corresponding to the content, when Ta, Co, and Sb are contained in excess of 0.1%, 1.0%, and 1.0%, respectively. For this reason, Ta, Co, and Sb, when contained, are contained in amounts of 0.01 to 0.1%, 0.01 to 1.0%, and 0.01 to 1.0%, respectively.

The following describes the reasons for limiting the structure of the high-strength seamless stainless steel pipe for oil country tubular goods according to aspects of the present invention.

In addition to the foregoing composition, the high-strength seamless stainless steel pipe for oil country tubular goods according to aspects of the present invention has a structure including more than 45% by volume martensite phase (tempered martensite phase) as a primary phase (base phase), and 10 to 45% by volume ferrite phase and 30% or less by volume retained austenite phase as a secondary phase.

In the seamless steel pipe according to aspects of the present invention, the base phase is the martensite phase (tempered martensite phase), and the volume fraction of the martensite phase is more than 45% to provide the desired high strength. When the martensite phase is more than 85%, the desired corrosion resistance, and the desired ductility and toughness may not be obtained as the contents of the ferrite phase and the retained austenite phase become smaller. For this reason, the martensite phase is preferably 85% or less. The martensite phase is primarily a tempered martensite phase and an as-quenched martensite phase is preferably 10% or less, if any. In accordance with aspects of the present invention, in order to provide the desired corrosion resistance (carbon dioxide corrosion resistance, sulfide stress cracking resistance (SSC resistance), and sulfide stress corrosion cracking resistance (SCC resistance)), at least a ferrite phase is precipitated in the amount of 10 to 45% by volume as a secondary phase to form a dual phase structure of the martensite phase (tempered martensite phase) and the ferrite phase. This forms a laminar structure along the pipe axis direction, and inhibits crack propagation in thickness direction. The laminar structure does not form, and the desired improvement of corrosion resistance cannot be obtained when the ferrite phase is less than 10%. The desired high strength cannot be provided when the ferrite phase is precipitated in large quantity of more than 45%. For these reasons, the ferrite phase as a secondary phase is 10 to 45%, preferably 20 to 40% by volume.

In addition to the ferrite phase, 30% or less by volume of a retained austenite phase is precipitated as a secondary phase. Ductility and toughness improve with the presence of the retained austenite phase. The desired high strength cannot be provided when the retained austenite phase is present in abundance with a volume fraction of more than 30%. Preferably, the retained austenite phase is 5% or more and 30% or less by volume.

For the measurement of the structure of the seamless steel pipe according to aspects of the present invention, a test piece for structure observation is etched with Vilella's reagent (a mixed reagent containing 2 g of picric acid, 10 ml of hydrochloric acid, and 100 ml of ethanol), and the structure is imaged with a scanning electron microscope (magnification: 1,000 times). The structure fraction of the ferrite phase (volume %) is then calculated with an image analyzer.

A test piece for X-ray diffraction is prepared by grounding and polishing so as to provide a measurement cross sectional surface (C cross section) orthogonal to the pipe axis direction, and the volume of retained austenite ($\gamma$) is measured by X-ray diffractometry. The retained austenite volume is calculated by measuring the diffraction X-ray integral intensities of the 7 (220) plane and the $\alpha$ (211) plane, and converting the results using the following equation.

$$\gamma(\text{volume fraction})=100/(1+(I\alpha R\gamma/I\gamma R\alpha))$$

In the equation, $I\alpha$ represents the integral intensity of $\alpha$, $R\alpha$ represents a crystallographic theoretical value for $\alpha$, $I\gamma$ represents the integral intensity of $\gamma$, and $R\gamma$ represents a crystallographic theoretical value for $\gamma$.

The fraction of the martensite phase is the fraction other than the ferrite phase and the retained austenite phase.

The structure of the seamless steel pipe according to aspects of the present invention may be adjusted by a heat treatment (quenching and tempering) performed under the specific conditions described below.

A desired method of production of the high-strength seamless stainless steel pipe for oil country tubular goods according to aspects of the present invention is described below.

In accordance with aspects of the present invention, a seamless stainless steel pipe of the composition described above is used as a starting material. The method of production of the starting material seamless stainless steel pipe is not particularly limited, and, typically, any known seamless steel pipe production method may be used.

Preferably, a molten steel of the foregoing composition is made by using an ordinary steel making process such as by using a converter, and formed into a steel pipe material, for example, a billet, using an ordinary method such as continuous casting, and ingot casting-blooming. The steel pipe material is heated, and hot worked using typically a known pipe manufacturing process, for example, such as the Mannesmann-plug mill process, and the Mannesmann-mandrel mill process to produce a seamless steel pipe of the foregoing composition and of the desired dimension's.

After producing the seamless steel pipe, the steel pipe is cooled to preferably room temperature at a cooling rate faster than air cooling. This process produces a steel pipe structure having a martensite phase as a base phase. The seamless steel pipe may be produced through hot extrusion by pressing.

Here, "cooling rate faster than air cooling" means 0.05° C./s or more, and "room temperature" means 40° C. or less.

In accordance with aspects of the present invention, the cooling of the seamless steel pipe to room temperature at a cooling rate faster than air cooling is followed by quenching, in which the steel pipe is heated to a temperature of 850° C. or more, and cooled to a temperature of 50° C. or less at a cooling rate faster than air cooling. In this way, the seamless steel pipe can have a structure containing an appropriate volume of ferrite phase with a martensite phase as a base phase. Here, "cooling rate faster than air cooling" means 0.05° C./s or more, and "room temperature" means 40° C. or less.

The desired high strength cannot be provided when the heating temperature for quenching is less than 850° C. From the viewpoint of preventing coarsening of the structure, the heating temperature for quenching is preferably 1,150° C. or less, more preferably in the range of 900 to 1,100° C.

The quenching of the seamless steel pipe is followed by tempering, in which the seamless steel pipe is heated to a tempering temperature equal to or less than the $Ac_1$ transformation point, and cooled (natural cooling). The tempering that heats the steel pipe to a tempering temperature equal to or less than the $Ac_1$ transformation point, and cools the steel pipe produces a structure having a tempered martensite phase, a ferrite phase, and a retained austenite phase (retained γ phase). The product is the high-strength seamless stainless steel pipe having the desired high strength, high toughness, and excellent corrosion resistance. When the tempering temperature is high and above the $Ac_1$ transformation point, the process produces as-quenched martensite, and fails to provide the desired high strength, high toughness, and excellent corrosion resistance. Preferably, tempering temperature is 700° C. or less, preferably 550° C. or more.

The steel containing the predetermined components needs to be subjected to the tempering process under predetermined conditions to make the amount of precipitated Cr+precipitated Mo+precipitated W 0.75% or less. The total amount of precipitated Cr, precipitated Mo, and precipitated W can become 0.75 mass % or less when the content of each component is adjusted to satisfy the following formula (3) that includes the components, tempering temperature, and tempering time.

$$t/(3956-2.9Cr-92.1Mo-50W+61.7Ni+99Cu-5.3T) \leq 0.034 \quad \text{Formula (3)}$$

In the formula (3), T represents the tempering temperature (° C.), and t represents the duration of tempering (min). Cr, Mo, W, Ni, and Cu represent the contents of corresponding elements (mass %), respectively.

When the value on the left-hand side of the formula (3) exceeds 0.034, the total amount of precipitated Cr, precipitated Mo, and precipitated W is larger than 0.75% by mass and the desired low-temperature toughness cannot be obtained.

EXAMPLES

The present invention is further described below through Examples.

Molten steels of the compositions shown in Table 1 were produced by a converter, and cast into billets (steel pipe material) by continuous casting. The steel pipe material was then hot worked with a model seamless rolling machine to produce a seamless steel pipe measuring 83.8 mm in outer diameter and 12.7 mm in wall thickness. After production, the seamless steel pipe was air cooled.

A test piece material was cut out from each seamless steel pipe obtained, and then subjected to quenching in which the test piece material was heated under the conditions shown in Table 2, and then cooled. This was followed by tempering, in which the test piece material was heated under the conditions shown in Table 2, and air cooled.

A test piece for structure observation was collected from the quenched and tempered test piece material, and etched with Vilella's reagent (a mixed reagent containing 2 g of picric acid, 10 ml of hydrochloric acid, and 100 ml of ethanol). The structure was imaged, with a scanning electron microscope (magnification: 1,000 times), and the structure fraction (volume %) of the ferrite phase was calculated with an image analyzer.

The structure fraction of the retained austenite phase was measured using X-ray diffractometry. A measurement test piece was collected from the quenched and tempered test piece material, and the diffraction X-ray integrated intensities of the γ (220) plane and the α (211) plane were measured by X-ray diffractometry. The results were then converted using the following equation.

$$\gamma(\text{volume fraction})=100/(1+(I\alpha R\gamma/I\gamma R\alpha))$$

In the equation, Iα represents the integrated intensity of α, Rα represents a crystallographic theoretical value for α, Iγ represents the integrated intensity of γ, and Rγ represents a crystallographic theoretical value for γ.

The fraction of the martensite phase was calculated as the fraction other than these phases.

A strip specimen specified by API standard 5CT was collected from the quenched and tempered test piece material, and subjected to a tensile test according to the API specifications to determine its tensile characteristics (yield strength YS, tensile strength TS). Separately, a V-notch test piece (10 mm thick) was collected from the quenched and tempered test piece material according to the JIS Z 2242 specifications. The test piece was subjected to a Charpy impact test, and the absorption energy at −40° C., −20° C. and −10° C. were determined for toughness evaluation.

The amounts of precipitated Cr, precipitated Mo, and precipitated W in the state after the heat treatment were investigated using an electroextraction residue method. In the electroextraction residue method, a test material was first subjected to galvanostatic electrolysis in a 10% AA-based electrolytic solution (10 vol % acetylacetone and 1 mass % tetramethylammonium chloride in methanol). The resulting electrolytic solution was filtered with a 0.2 μm-mesh filter, and the filtered electrolytic solution was analyzed using an ICP emission spectral analyzer to measure the amounts of Cr, Mo, and W in the electrolytic solution. The measured amounts were used as the amounts of precipitation of these elements.

A corrosion test piece measuring 3.0 mm in wall thickness, 30 mm in width, and 40 mm in length was machined from the quenched and tempered test piece material, and subjected to a corrosion test.

The corrosion test was conducted by dipping the test piece for 336 hours in a test solution: a 20 mass % NaCl aqueous solution (liquid temperature: 200° C., a 30 atm $CO_2$ gas atmosphere) charged into an autoclave. After the test, the mass of the test piece was measured, and the corrosion rate was determined from the calculated weight reduction before and after the corrosion test. The test piece after the corrosion test was also observed for the presence or absence of pitting corrosion on a test piece surface using a loupe (10 times magnification). Corrosion with a pit having a diameter of 0.2 mm or more was regarded as pitting corrosion.

A round rod-shaped test piece (diameter ϕ=6.4 mm) was machined from the quenched and tempered test piece material according to NACE TM0177, Method A, and subjected to an SSC resistance test.

A 4-point bend test piece measuring 3 mm in wall thickness, 15 mm in width, and 115 mm in length was collected by machining the quenched and tempered test piece material, and subjected to an SCC resistance test.

In the SCC (sulfide stress corrosion crack) resistance test, the test piece was dipped in a test solution: an aqueous solution having an adjusted pH of 3.3 with addition of an aqueous solution of acetic acid and sodium acetate to a 20 mass % NaCl aqueous solution (liquid temperature: 100° C.; 0.1 atm $H_2S$ and 30 atm $CO_2$ atmosphere) hold in an autoclave. The test piece was kept in the solution for 720 hours while applying a stress equal to 100% of the yield stress. After the test, the test piece was observed for the presence or absence of cracking.

In the SSC (sulfide stress crack) resistance test, the test piece was dipped in a test solution: an aqueous solution having an adjusted pH of 3.5 with addition of an aqueous solution of acetic acid and sodium acetate to a 20 mass % NaCl aqueous solution (liquid temperature: 25° C.; 0.1 atm $H_2S$ and 0.9 atm $CO_2$ atmosphere). The test piece was kept in the solution for. 720 hours while applying a stress equal to 90% of the yield stress. After the test, the test piece was observed for the presence or absence of cracking.

The results are presented in Table 2.

TABLE 1

| Steel No. | Composition (mass %) C | Si | Mn | P | S | Cr | Ni | Mo | Cu | V | W | N | Al | Nb, Ti, Zr, B, | REM, Ca, Sn, Mg | Ta, Co, Sb | Value on left-hand side of formula (1) (*1) | Value on left-hand side of formula (2) (*2) |
|---|---|---|---|---|---|---|---|---|---|---|---|---|---|---|---|---|---|---|
| A | 0.010 | 0.21 | 0.28 | 0.013 | 0.0009 | 15.0 | 4.7 | 3.9 | 2.5 | 0.048 | 1.2 | 0.010 | 0.016 | — | — | — | 26.7 | 32.1 |
| B | 0.008 | 0.21 | 0.28 | 0.015 | 0.0008 | 15.1 | 4.3 | 3.5 | 2.5 | 0.050 | 1.2 | 0.010 | 0.024 | — | — | — | 27.3 | 30.8 |
| C | 0.014 | 0.20 | 0.28 | 0.014 | 0.0008 | 15.4 | 4.1 | 3.1 | 2.5 | 0.051 | 1.2 | 0.015 | 0.019 | — | — | — | 26.5 | 30.3 |
| D | 0.010 | 0.20 | 0.28 | 0.013 | 0.0008 | 16.0 | 4.5 | 3.0 | 2.5 | 0.051 | 1.2 | 0.008 | 0.024 | — | — | — | 27.2 | 31.7 |
| E | 0.011 | 0.21 | 0.28 | 0.013 | 0.0010 | 15.0 | 3.8 | 4.5 | 2.6 | 0.052 | 1.2 | 0.013 | 0.021 | Nb: 0.145 | — | — | 35.9 | 30.9 |
| F | 0.012 | 0.21 | 0.28 | 0.014 | 0.0012 | 14.7 | 4.4 | 4.3 | 2.6 | 0.047 | 0.9 | 0.010 | 0.020 | — | — | — | 28.9 | 31.3 |
| G | 0.011 | 0.20 | 0.29 | 0.015 | 0.0011 | 15.8 | 3.7 | 3.0 | 2.8 | 0.053 | 0.9 | 0.007 | 0.021 | — | — | — | 30.9 | 29.9 |
| H | 0.012 | 0.20 | 0.29 | 0.015 | 0.0009 | 15.7 | 3.8 | 3.0 | 2.6 | 0.056 | 1.5 | 0.008 | 0.025 | — | — | — | 29.4 | 30.3 |
| I | 0.034 | 0.20 | 0.29 | 0.015 | 0.0010 | 15.6 | 3.0 | 3.0 | 2.6 | 0.053 | 1.2 | 0.052 | 0.023 | Nb: 0.056 | — | — | 26.6 | 28.3 |
| J | 0.007 | 0.19 | 0.28 | 0.016 | 0.0007 | 15.1 | 4.3 | 3.6 | 2.6 | 0.048 | 1.1 | 0.008 | 0.023 | — | REM: 0.021, Ca: 0.0021 | — | 28.0 | 31.0 |
| K | 0.009 | 0.22 | 0.26 | 0.015 | 0.0007 | 14.9 | 4.4 | 3.6 | 2.5 | 0.048 | 1.2 | 0.010 | 0.023 | — | — | Ta: 0.02, Co: 0.24 | 26.2 | 31.0 |
| L | 0.007 | 0.21 | 0.26 | 0.015 | 0.0009 | 15.1 | 4.4 | 3.4 | 2.5 | 0.042 | 1.1 | 0.008 | 0.025 | Ti: 0.054, Zr: 0.10 | Sn: 0.13, Mg: 0.0007 | — | 26.4 | 30.9 |
| M | 0.007 | 0.21 | 0.26 | 0.014 | 0.0008 | 14.8 | 4.3 | 3.6 | 2.4 | 0.047 | 1.1 | 0.009 | 0.023 | Ti: 0.046, B: 0.0018 | — | Sb: 0.14 | 26.7 | 30.5 |
| N | 0.007 | 0.20 | 0.26 | 0.016 | 0.0007 | 14.9 | 4.3 | 3.5 | 2.5 | 0.046 | 1.1 | 0.011 | 0.022 | — | Ca: 0.0020, Mg: 0.0009 | Ta: 0.02, Sb: 0.12 | 26.3 | 30.6 |
| O | 0.010 | 0.21 | 0.29 | 0.014 | 0.0007 | 15.1 | 4.5 | 3.6 | 2.5 | 0.042 | 1.1 | 0.009 | 0.023 | Zr: 0.08, B: 0.0014 | REM: 0.021, Sn: 0.11 | Co: 0.26 | 26.5 | 31.3 |
| P | 0.011 | 0.23 | 0.29 | 0.013 | 0.0009 | 15.1 | 5.5 | 3.7 | 2.4 | 0.051 | 1.2 | 0.011 | 0.014 | — | — | — | 21.2 | 33.4 |
| Q | 0.012 | 0.20 | 0.31 | 0.015 | 0.0011 | 15.7 | 3.7 | 2.8 | 3.4 | 0.043 | 1.0 | 0.007 | 0.021 | — | — | — | 27.8 | 30.3 |
| R | 0.010 | 0.22 | 0.28 | 0.014 | 0.0009 | 15.6 | 3.6 | 2.9 | 2.6 | 0.154 | 1.6 | 0.008 | 0.025 | — | — | — | 30.0 | 29.9 |
| S | 0.038 | 0.24 | 0.32 | 0.015 | 0.0009 | 16.8 | 3.7 | 2.8 | 0.9 | 0.066 | 1.0 | 0.044 | 0.039 | Nb: 0.069 | — | — | 30.3 | 28.9 |
| T | 0.012 | 0.19 | 0.30 | 0.015 | 0.0010 | 15.6 | 3.7 | 2.9 | 2.9 | 0.050 | 0.8 | 0.007 | 0.020 | — | — | — | 28.5 | 29.6 |
| U | 0.012 | 0.22 | 0.31 | 0.013 | 0.0009 | 16.1 | 4.1 | 4.3 | 2.6 | 0.045 | 1.3 | 0.015 | 0.020 | — | — | — | 37.9 | 32.5 |
| V | 0.012 | 0.20 | 0.29 | 0.015 | 0.0008 | 14.7 | 2.7 | 3.0 | 2.6 | 0.054 | 0.9 | 0.011 | 0.019 | — | — | — | 30.1 | 26.7 |
| W | 0.033 | 0.25 | 0.30 | 0.015 | 0.0010 | 16.4 | 3.9 | 2.5 | 1.0 | 0.057 | 1.0 | 0.045 | 0.040 | — | — | — | 25.2 | 28.7 |
| X | 0.027 | 0.24 | 0.31 | 0.015 | 0.0011 | 17.8 | 3.7 | 2.8 | 1.0 | 0.052 | 1.0 | 0.049 | 0.044 | — | — | — | 37.0 | 30.0 |
| Y | 0.011 | 0.23 | 0.28 | 0.013 | 0.0009 | 14.9 | 6.2 | 3.6 | 2.5 | 0.050 | 1.0 | 0.009 | 0.015 | — | — | — | 15.3 | 34.4 |
| Z | 0.012 | 0.21 | 0.29 | 0.013 | 0.0009 | 14.8 | 3.7 | 5.3 | 2.5 | 0.044 | 1.1 | 0.011 | 0.019 | — | — | — | 40.2 | 31.1 |
| AA | 0.012 | 0.20 | 0.31 | 0.015 | 0.0010 | 15.5 | 3.5 | 3.3 | 4.4 | 0.059 | 1.0 | 0.007 | 0.019 | — | — | — | 30.1 | 31.2 |
| AB | 0.012 | 0.21 | 0.29 | 0.016 | 0.0008 | 14.2 | 3.1 | 2.9 | 2.5 | 0.060 | 0.9 | 0.011 | 0.020 | — | — | — | 25.0 | 26.7 |
| AC | 0.031 | 0.23 | 0.33 | 0.014 | 0.0011 | 16.3 | 3.7 | 2.9 | 0.2 | 0.059 | 0.9 | 0.051 | 0.037 | — | — | — | 29.7 | 27.7 |
| AD | 0.028 | 0.23 | 0.32 | 0.015 | 0.0009 | 16.7 | 4.2 | 2.9 | 0.9 | 0.014 | 1.0 | 0.044 | 0.043 | — | — | — | 29.0 | 29.9 |
| AE | 0.033 | 0.27 | 0.32 | 0.016 | 0.0010 | 16.2 | 3.7 | 2.8 | 1.1 | 0.058 | — | 0.039 | 0.042 | — | — | — | 28.2 | 27.5 |
| AF | 0.009 | 0.20 | 0.31 | 0.019 | 0.0006 | 14.6 | 5.7 | 2.8 | 2.1 | 0.056 | 0.9 | 0.008 | 0.020 | — | — | | 12.2 | 31.8 |
| AG | 0.025 | 0.28 | 0.33 | 0.018 | 0.0006 | 17.1 | 5.6 | 3.3 | 2.1 | 0.049 | 1.4 | 0.052 | 0.050 | — | — | — | 24.3 | 35.1 |

The balance is Fe and unavoidable impurities (*1) Value on the left-hand side of formula (1) = −5.9 × (7.82 + 27C − 0.91Si + 0.21Mn − 0.9Cr + Ni − 1. 1Mo + 0.2Cu +11N) (In the formula, C, Si, Mn, Cr, Ni, Mo, Cu, and N represent the contents of corresponding elements (mass %), respectively)

(*2) Value on the left-hand side of formula (2) = Cu + Mo + W + Cr + 2Ni (In the formula, Cu, Mo, W, Cr, and Ni represent the contents of corresponding elements (mass %), respectively)

TABLE 2

| Steel No. | Steel pipe No. | Quenching: Heating temperature (° C.) | Quenching: Duration (min) | Tempering: Heating temperature (° C.) | Tempering: Duration (min) | Value on left-hand side of formula (3) (*1) | Structure (volume %): M (*2) | Structure (volume %): F (*2) | Structure (volume %): A (*2) | Precipitate (mass%): Precipitated Cr | Precipitate (mass%): Precipitated Mo | Precipitate (mass%): Precipitated W | Precipitated Cr + Mo + W (*3) | Yield strength YS (MPa) | Tensile strength TS (MPa) | $vE_{40}$ (J) | $vE_{20}$ (J) | $vE_{10}$ (J) | Corrosion rate (mm/y) | Pitting corrosion | SSC | SCC | Remarks |
|---|---|---|---|---|---|---|---|---|---|---|---|---|---|---|---|---|---|---|---|---|---|---|---|
| A | 1 | 1050 | 20 | 575 | 30 | 0.030 | 61 | 31 | 8 | 0.11 | 0.21 | 0.01 | 0.33 | 977 | 1052 | 154 | 225 | 224 | 0.033 | Absent | ○ | ○ | Present example |
| B | 2 | 1030 | 20 | 575 | 30 | 0.030 | 65 | 30 | 5 | 0.14 | 0.07 | 0.01 | 0.22 | 952 | 1012 | 156 | 232 | 261 | 0.035 | Absent | ○ | ○ | Present example |
| C | 3 | 1000 | 20 | 565 | 30 | 0.028 | 67 | 29 | 4 | 0.06 | 0.01 | 0.01 | 0.08 | 963 | 1013 | 186 | 228 | 288 | 0.035 | Absent | ○ | ○ | Present example |
| D | 4 | 1000 | 20 | 565 | 30 | 0.027 | 61 | 34 | 5 | 0.05 | 0.01 | 0.01 | 0.07 | 969 | 1018 | 130 | 184 | 203 | 0.029 | Absent | ○ | ○ | Present example |
| E | 5 | 1050 | 20 | 570 | 30 | 0.033 | 49 | 43 | 8 | 0.10 | 0.24 | 0.01 | 0.35 | 954 | 1066 | 105 | 141 | 209 | 0.033 | Absent | ○ | ○ | Present example |
| F | 6 | 1050 | 20 | 570 | 30 | 0.031 | 58 | 35 | 7 | 0.09 | 0.18 | 0.01 | 0.28 | 948 | 1082 | 122 | 182 | 200 | 0.044 | Absent | ○ | ○ | Present example |
| G | 7 | 980 | 20 | 590 | 30 | 0.031 | 67 | 31 | 2 | 0.23 | 0.20 | 0.07 | 0.50 | 886 | 953 | 152 | 214 | 227 | 0.036 | Absent | ○ | ○ | Present example |
| H | 8 | 1000 | 20 | 560 | 30 | 0.028 | 66 | 32 | 2 | 0.03 | 0.01 | 0.01 | 0.05 | 968 | 1028 | 156 | 260 | 230 | 0.027 | Absent | ○ | ○ | Present example |
| I | 9 | 980 | 20 | 580 | 30 | 0.032 | 64 | 30 | 6 | 0.18 | 0.02 | 0.02 | 0.22 | 958 | 1135 | 147 | 224 | 217 | 0.050 | Absent | ○ | ○ | Present example |
| J | 10 | 1030 | 20 | 575 | 30 | 0.030 | 66 | 29 | 5 | 0.16 | 0.10 | 0.01 | 0.27 | 970 | 1024 | 126 | 217 | 224 | 0.036 | Absent | ○ | ○ | Present example |
| K | 11 | 1030 | 20 | 575 | 30 | 0.030 | 65 | 30 | 5 | 0.13 | 0.09 | 0.01 | 0.23 | 972 | 1018 | 160 | 229 | 243 | 0.032 | Absent | ○ | ○ | Present example |
| L | 12 | 1010 | 20 | 575 | 30 | 0.030 | 65 | 32 | 3 | 0.15 | 0.05 | 0.01 | 0.21 | 964 | 1018 | 172 | 247 | 280 | 0.025 | Absent | ○ | ○ | Present example |
| M | 13 | 1030 | 20 | 575 | 30 | 0.031 | 68 | 29 | 3 | 0.13 | 0.08 | 0.01 | 0.22 | 926 | 1021 | 171 | 248 | 276 | 0.045 | Absent | ○ | ○ | Present example |
| N | 14 | 1030 | 20 | 575 | 30 | 0.030 | 64 | 32 | 4 | 0.16 | 0.07 | 0.01 | 0.24 | 970 | 1009 | 153 | 216 | 231 | 0.033 | Absent | ○ | ○ | Present example |
| O | 15 | 1030 | 20 | 575 | 30 | 0.030 | 62 | 32 | 6 | 0.13 | 0.11 | 0.01 | 0.25 | 950 | 1030 | 186 | 255 | 271 | 0.028 | Absent | ○ | ○ | Present example |
| P | 16 | 1050 | 20 | 575 | 30 | 0.029 | 64 | 25 | 11 | 0.12 | 0.13 | 0.01 | 0.24 | 916 | 1062 | 175 | 227 | 277 | 0.031 | Absent | ○ | ○ | Present example |
| Q | 17 | 980 | 20 | 590 | 30 | 0.029 | 72 | 26 | 2 | 0.28 | 0.18 | 0.08 | 0.54 | 931 | 1053 | 123 | 230 | 208 | 0.031 | Absent | ○ | ○ | Present example |
| R | 18 | 1000 | 20 | 560 | 30 | 0.028 | 66 | 31 | 3 | 0.03 | 0.01 | 0.01 | 0.05 | 934 | 1034 | 110 | 205 | 207 | 0.027 | Absent | ○ | ○ | Present example |
| S | 19 | 970 | 20 | 560 | 30 | 0.032 | 56 | 38 | 6 | 0.03 | 0.01 | 0.01 | 0.05 | 920 | 1055 | 117 | 151 | 224 | 0.019 | Absent | ○ | ○ | Present example |
| T | 20 | 980 | 20 | 590 | 30 | 0.030 | 64 | 36 | 0 | 0.22 | 0.21 | 0.06 | 0.49 | 958 | 1007 | 107 | 181 | 203 | 0.034 | Absent | ○ | ○ | Present example |

TABLE 2-continued

| Steel No. | Steel pipe No. | Quenching: Heating temperature (° C.) | Quenching: Duration (min) | Tempering: Heating temperature (° C.) | Tempering: Duration (min) | Value on left-hand side of formula (3) (*1) | Structure (volume %): M (*2) | Structure (volume %): F (*2) | Structure (volume %): A (*2) | Precipitate (mass%): Precipitated Cr | Precipitate (mass%): Precipitated Mo | Precipitate (mass%): Precipitated W | Precipitate (mass%): Precipitated Cr + Mo + W (*3) | Yield strength YS (MPa) | Tensile strength TS (MPa) | $vE_{40}$ (J) | $vE_{20}$ (J) | $vE_{10}$ (J) | Corrosion rate (mm/y) | Pitting corrosion | SSC | SCC | Remarks |
|---|---|---|---|---|---|---|---|---|---|---|---|---|---|---|---|---|---|---|---|---|---|---|---|
| U | 21 | 1050 | 20 | 585 | 30 | 0.035 | 40 | 46 | 14 | 0.24 | 0.49 | 0.05 | 0.78 | 852 | 1002 | 21 | 105 | 104 | 0.033 | Absent | ○ | ○ | Comparative example |
| V | 22 | 960 | 20 | 570 | 30 | 0.030 | 69 | 31 | 0 | 0.09 | 0.01 | 0.01 | 0.11 | 938 | 1031 | 77 | 123 | 166 | 0.068 | Absent | X | X | Comparative example |
| W | 23 | 970 | 20 | 560 | 30 | 0.030 | 65 | 30 | 5 | 0.02 | 0.01 | 0.01 | 0.04 | 862 | 1016 | 106 | 154 | 202 | 0.030 | Absent | X | X | Comparative example |
| X | 24 | 970 | 20 | 560 | 30 | 0.032 | 55 | 36 | 9 | 0.02 | 0.01 | 0.01 | 0.04 | 842 | 1023 | 32 | 114 | 119 | 0.010 | Absent | ○ | ○ | Comparative example |
| Y | 25 | 1050 | 20 | 575 | 30 | 0.027 | 67 | 21 | 12 | 0.11 | 0.10 | 0.01 | 0.22 | 850 | 1039 | 230 | 315 | 358 | 0.030 | Absent | ○ | ○ | Comparative example |
| Z | 26 | 1080 | 20 | 580 | 30 | 0.039 | 54 | 36 | 10 | 0.17 | 0.71 | 0.01 | 0.89 | 912 | 1043 | 30 | 117 | 120 | 0.030 | Present | X | X | Comparative example |
| AA | 27 | 980 | 20 | 590 | 30 | 0.028 | 59 | 35 | 6 | 0.20 | 0.27 | 0.06 | 0.53 | 916 | 1017 | 131 | 201 | 202 | 0.038 | Absent | X | X | Comparative example |
| AB | 28 | 960 | 20 | 570 | 30 | 0.030 | 65 | 35 | 0 | 0.09 | 0.01 | 0.01 | 0.11 | 942 | 1020 | 115 | 173 | 208 | 0.139 | Present | X | X | Comparative example |
| AC | 29 | 970 | 20 | 555 | 30 | 0.033 | 64 | 33 | 3 | 0.01 | 0.01 | 0.01 | 0.03 | 936 | 1019 | 123 | 215 | 219 | 0.027 | Absent | X | X | Comparative example |
| AD | 30 | 970 | 20 | 560 | 30 | 0.031 | 62 | 30 | 8 | 0.02 | 0.01 | 0.01 | 0.04 | 854 | 1058 | 122 | 211 | 223 | 0.016 | Absent | O | O | Comparative example |
| AE | 31 | 970 | 20 | 560 | 30 | 0.029 | 67 | 32 | 1 | 0.03 | 0.01 | 0.01 | 0.05 | 847 | 1048 | 157 | 187 | 233 | 0.024 | Present | X | X | Comparative example |
| AF | 32 | 1000 | 20 | 595 | 30 | 0.030 | 80 | 17 | 3 | 0.22 | 0.27 | 0.08 | 0.57 | 936 | 1042 | 241 | 324 | 322 | 0.044 | Absent | X | X | Comparative example |
| AG | 33 | 1040 | 20 | 550 | 30 | 0.026 | 51 | 31 | 18 | 0.01 | 0.01 | 0.01 | 0.03 | 852 | 1034 | 230 | 329 | 301 | 0.009 | Absent | ○ | ○ | Comparative example |
| E | 34 | 1050 | 20 | 585 | 30 | 0.036 | 51 | 40 | 9 | 0.24 | 0.49 | 0.05 | 0.78 | 900 | 1002 | 27 | 106 | 102 | 0.033 | Absent | ○ | ○ | Comparative example |
| I | 35 | 980 | 20 | 600 | 30 | 0.035 | 61 | 33 | 6 | 0.33 | 0.47 | 0.13 | 0.93 | 879 | 1081 | 20 | 106 | 103 | 0.041 | Absent | ○ | ○ | Comparative example |

(*1) Value on the left-hand side of formula (3) = t/(3956 − 2.9Cr − 92.1Mo − 50W + 61.7Ni + 99Cu − 5.3T) (T: Tempering temperature (° C.), t: Duration of tempering (min), Cr, Mo, W, Ni, and Cu: Content of each element (mass %))

(*2) M: Martensite phase, F: Ferrite phase, A: Retained austenite phase (*3) Precipitated Cr + Mo + W: Total amount of precipitated Cr, precipitated Mo, and precipitated W (mass %)

The high-strength seamless stainless steel pipes of the present examples all had high strength with a yield strength of 862 MPa or more, high toughness with an absorption energy at −40° C. of 100 J or more, and excellent corrosion resistance (carbon dioxide corrosion resistance) in a high-temperature, $CO_2$- and $Cl^-$-containing 200° C. corrosive environment. The high-strength seamless stainless steel pipes of the present examples produced no cracks (SSC, SCC) in the $H_2S$-containing environment, and had excellent sulfide stress cracking resistance, and excellent sulfide stress corrosion cracking resistance.

On the other hand, comparative examples outside of the range of the present invention did not have at least one of the desired high strength, low-temperature toughness, carbon dioxide corrosion resistance, sulfide stress cracking resistance (SSC resistance), and sulfide stress corrosion cracking resistance (SCC resistance).

Steel pipe No. 21 had more than 45% ferrite phase, and the yield strength YS was less than 862 MPa. The vE-40 value was less than. 0.100 J with the total amount of precipitated Cr, precipitated Mo, and precipitated W exceeding 0.75% by mass.

Steel pipe No. 22 (steel No. V) had a Ni content of less than 3.0 mass %, and the desired SSC resistance and SCC resistance were not obtained.

Steel pipe No. 23 (steel No. W) had a Mo content of less than 2.7 mass %, and the desired SSC resistance and SCC resistance were not obtained.

Steel pipe No. 24 (steel No. X) had a Cr content of more than 17.5 mass %, and the yield strength YS was less than 862 MPa.

Steel pipe No. 25 (steel No. Y) had a Ni content of more than 6.0 mass %, and the yield strength YS was less than 862 MPa.

Steel pipe No. 26 (steel No. Z) had a Mo content of more than 5.0 mass %, and the total amount of precipitated Cr, precipitated Mo, and precipitated W was more than 0.75% by mass. The vE-40 value was less than 100 J accordingly. As a result, pitting corrosion occurred, and the desired SSC resistance and SCC resistance were not obtained.

Steel pipe No. 27 (steel No. AA) had a Cu content of more than 4.0 mass %, and the desired SSC resistance and SCC resistance were not obtained.

Steel pipe No. 28 (steel No. AB) had a Cr content of less than 14.5 mass %. As a result, pitting corrosion occurred, and the desired SSC resistance and SCC resistance were not obtained.

Steel pipe No. 29 (steel No. AC) had a Cu content of less than 0.3 mass %, and the desired SSC resistance and SCC resistance were not obtained.

Steel pipe No. 30 (steel No. AD) had a V content of less than 0.02 mass %, and the yield strength YS was less than 862 MPa.

Steel pipe No. 31 (steel No. AE) had a W content of less than 0.1 mass %, and the yield strength YS was less than 862 MPa. As a result, pitting corrosion occurred, and the desired SSC resistance and SCC resistance were not obtained.

In steel pipe No. 32 (steel No. AF), the value on the left-hand side of the formula (1) was less than 13.0, and the desired SSC resistance and SCC resistance were not obtained.

In steel pipe No. 33 (steel No. AG), the value on the left-hand side of the formula (2) was more than 34.5, and the yield strength YS was less than 862 MPa.

In steel pipe No. 34, the total amount of precipitated Cr, precipitated Mo, and precipitated W was more than 0.75% by mass; and the vE-40 value was less than 100 J.

In steel pipe No. 35, the total amount of precipitated Cr, precipitated Mo, and precipitated W was more than 0.75% by mass, and the vE-40 value was less than 100 J.

The invention claimed is:

1. A high-strength seamless stainless steel pipe for oil country tubular goods having a yield strength of 862 MPa or more, the high-strength seamless stainless steel pipe having a composition that comprises, in mass %, C: 0.05% or less, Si: 0.5% or less, Mn: 0.15 to 1.0%, P: 0.030% or less, S: 0.005% or less, Cr: 14.5 to 17.5%, Ni: 3.0 to 6.0%, Mo: 2.7 to 5.0%, Cu: 0.3 to 4.0%, W: 1.0% to 2.5%, V: 0.02 to 0.20%, Al: 0.10% or less, N: 0.15% or less, and the balance being Fe and unavoidable impurities, and in which the C, Si, Mn, Cr, Ni, Mo, Cu, and N satisfy the formula (1) below, the Cu, Mo, W, Cr, and Ni satisfy the formula (2) below, and tempering conditions during production of the high-strength seamless stainless steel pipe for oil country tubular goods satisfy the formula (3) below, the high-strength seamless stainless steel pipe having a structure comprising more than 45% martensite phase by volume as a primary phase, and 10 to 45% ferrite phase and 30% or less retained austenite phase by volume as a secondary phase, wherein the total amount of precipitated Cr, precipitated Mo, and precipitated W is 0.75 mass % or less, $$-5.9\times(7.82+27C-0.91Si+0.21Mn-0.9Cr+Ni-1.1Mo+0.2Cu+11N)\geq 13.0 \quad (1),$$

where C, Si, Mn, Cr, Ni, Mo, Cu, and N represent the contents of corresponding elements (mass %), respectively, $$Cu+Mo+W+Cr+2Ni\leq 34.5 \quad (2),$$

where Cu, Mo, W, Cr, and Ni represent the contents of corresponding elements (mass %), respectively, $$t/(3956-2.9Cr-92.1Mo-50W+61.7Ni+99Cu-5.3T)\leq 0.034 \quad (3),$$

where T is a tempering temperature (° C.), t is a duration of tempering (min), and Cr, Mo, W, Ni, and Cu represent the contents of corresponding elements (mass %), respectively.

2. The high-strength seamless stainless steel pipe for oil country tubular goods according to claim 1, wherein the composition further comprises, in mass %, at least one selected from Nb: 0.02 to 0.50%, Ti: 0.02 to 0.16%, Zr: 0.02 to 0.50%, and B: 0.0005 to 0.0030%.

3. The high-strength seamless stainless steel pipe for oil country tubular goods according to claim 1, wherein the composition further comprises, in mass %, at least one selected from REM: 0.001 to 0.05%, Ca: 0.001 to 0.005%, Sn: 0.05 to 0.20%, and Mg: 0.0002 to 0.01%.

4. The high-strength seamless stainless steel pipe for oil country tubular goods according to claim 2, wherein the composition further comprises, in mass %, at least one selected from REM: 0.001 to 0.05%, Ca: 0.001 to 0.005%, Sn: 0.05 to 0.20%, and Mg: 0.0002 to 0.01%.

5. The high-strength seamless stainless steel pipe for oil country tubular goods according to claim 1, wherein the composition further comprises, in mass %, at least one selected from Ta: 0.01 to 0.1%, Co: 0.01 to 1.0%, and Sb:0.01 to 1.0%.

6. The high-strength seamless stainless steel pipe for oil country tubular goods according to claim 2, wherein the composition further comprises, in mass %, at least one selected from Ta: 0.01 to 0.1%, Co: 0.01 to 1.0%, and Sb:0.01 to 1.0%.

7. The high-strength seamless stainless steel pipe for oil country tubular goods according to claim 3, wherein the composition further comprises, in mass %, at least one selected from Ta: 0.01 to 0.1%, Co: 0.01 to 1.0%, and Sb:0.01 to 1.0%.

8. The high-strength seamless stainless steel pipe for oil country tubular goods according to claim 4, wherein the composition further comprises, in mass %, at least one selected from Ta: 0.01 to 0.1%, Co: 0.01 to 1.0%, and Sb:0.01 to 1.0%.

9. A method for producing the high-strength seamless stainless steel pipe for oil country tubular goods of claim 1, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

10. A method for producing the high-strength seamless stainless steel pipe for oil country tubular goods of claim 2, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

11. A method for producing the high-strength seamless stainless steel pipe for oil country tubular goods of claim 3, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

12. A method for producing the high-strength seamless stainless steel pipe for oil country tubular goods of claim 4, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

13. A method for producing the high-strength seamless stainless steel pipe for oil country tubular goods of claim 5, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

14. A method for producing the high-strength seamless stainless steel pipe for oil country tubular goods of claim 6, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

15. A method for producing the high-strength seamless stainless steel pipe for oil country tubular goods of claim 7, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9Cr-92.1Mo-50W+61.7Ni+99Cu-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

16. A method for producing the high-strength seamless stainless steel pipe for oil country tubular goods of claim 8, the method comprising:

heating a steel pipe material;

making the steel pipe material into a seamless steel pipe by hot working; and subjecting the hot worked seamless steel pipe to quenching and tempering in sequence, wherein tempering conditions of the tempering are adjusted so as to satisfy the following formula (3), $$t/(3956-2.9\mathrm{Cr}-92.1\mathrm{Mo}-50\mathrm{W}+61.7\mathrm{Ni}+99\mathrm{Cu}-5.3T) \leq 0.034 \quad (3),$$

where T is the tempering temperature (° C.), t is the duration of tempering (min), and Cr, Mo, W, Ni, and Cu represent the contents of corresponding elements (mass %), respectively.

* * * * *